US006732873B2

(12) United States Patent
Bried et al.

(10) Patent No.: US 6,732,873 B2
(45) Date of Patent: May 11, 2004

(54) CONTAINER LID

(75) Inventors: David K. Bried, Rockford, IL (US); George Solowiejko, Rockford, IL (US); Gary D. Johnson, Rockford, IL (US); C. Alan Peet, Waterman, IL (US); Philip M. Baerenwald, Rockton, IL (US); Michael A. Yarbro, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 0 days.

(21) Appl. No.: 09/803,462

(22) Filed: Mar. 9, 2001

(65) Prior Publication Data

US 2002/0125203 A1 Sep. 12, 2002

(51) Int. Cl.[7] ..... B65D 47/08

(52) U.S. Cl. ..... 215/235; 215/301; 220/281; 220/254.3; 220/254.1; 220/837; 220/839; 222/556

(58) Field of Search ..... 215/235, 237, 215/301, 295; 220/281, 839, 847, 836, 283, 837, 826, 827, 831–834, 254.1, 254.3, 254.7; 222/556, 517, 537, 498

(56) References Cited

U.S. PATENT DOCUMENTS

| | | | | |
|---|---|---|---|---|
| 3,217,949 | A | | 11/1965 | Davis |
| 3,323,671 | A | | 6/1967 | Minarik, Jr. et al. |
| 3,419,198 | A | | 12/1968 | Pettersen |
| 3,836,056 | A | | 9/1974 | Pehr |
| 3,845,872 | A | | 11/1974 | Towns et al. |
| 3,850,350 | A | | 11/1974 | Towns et al. |
| 4,010,875 | A | | 3/1977 | Babiol |
| 4,127,221 | A | | 11/1978 | Vere |
| 4,158,902 | A | | 6/1979 | Chernack et al. |
| 4,168,032 | A | | 9/1979 | Sneider |
| 4,209,100 | A | | 6/1980 | Uhlig |
| 4,220,248 | A | | 9/1980 | Wilson et al. |
| 4,223,814 | A | | 9/1980 | Sneider |
| 4,244,495 | A | | 1/1981 | Lorscheid et al. |
| 4,261,480 | A | | 4/1981 | Fuss |
| 4,291,818 | A | | 9/1981 | Nozawa et al. |
| 4,369,901 | A | | 1/1983 | Hidding |
| 4,371,095 | A | | 2/1983 | Montgomery et al. |
| 4,457,458 | A | | 7/1984 | Heinol |
| 4,494,679 | A | | 1/1985 | Cleevely |
| 4,504,009 | A | | 3/1985 | Boik et al. |
| 4,558,806 | A | | 12/1985 | Shabram, Sr. et al. |
| 4,580,687 | A | | 4/1986 | Lewis |
| 4,607,768 | A | * | 8/1986 | Taber et al. ..... 215/237 |
| D292,889 | S | | 11/1987 | Ostrowsky |
| 4,736,858 | A | | 4/1988 | Shastal |
| 4,775,065 | A | * | 10/1988 | Shastal ..... 215/235 |
| 4,776,501 | A | | 10/1988 | Ostrowsky |

(List continued on next page.)

OTHER PUBLICATIONS

Kwik–Wipes® pail by Stockhausen, 10 pages of photographs taken Sep., 2001.

*Primary Examiner*—Robin A. Hylton
(74) *Attorney, Agent, or Firm*—Leydig, Voit & Mayer, LTD

(57) ABSTRACT

A lid for a container is provided generally comprising a main body and a door having a flip section pivotally connected to a push section, the push section pivotally connected to the main body. The main body includes a recess that defines a pivot wall. The flip section is positioned to engage the pivot wall and rotate relative to the push section in response to downward pressure on the push section. A detent mechanism is used to control opening the door in at least two stages. In the first stage, the detent mechanism substantially fixes the push section in a closed position, and in the second stage substantially fixes the push section in an open position. In one embodiment, the floor of the recess is sloped to increase container space and limit flexure of the push section of the door.

31 Claims, 8 Drawing Sheets

U.S. PATENT DOCUMENTS 4,898,292 A 2/1990 VerWeyst et al.
4,901,892 A 2/1990 Song
4,911,337 A 3/1990 Rosenthal
4,923,085 A 5/1990 Lillelund et al.
4,936,494 A 6/1990 Weidman
D314,708 S 2/1991 DeCoster
D321,137 S 10/1991 Hofmann et al.
D322,760 S 12/1991 Blanchette
5,082,114 A 1/1992 Bunin
D328,711 S 8/1992 Deflander
D329,604 S 9/1992 Kuczer
5,163,559 A 11/1992 Bunin
D331,877 S 12/1992 Robichaud et al.
5,176,277 A 1/1993 Schuermann
5,193,722 A * 3/1993 Groya et al. ..... 220/832
5,195,645 A * 3/1993 Schuermann ..... 220/254.3
D335,817 S 5/1993 Greubel
D339,290 S 9/1993 Close
D340,188 S 10/1993 Forsyth
5,273,177 A 12/1993 Campbell
5,285,917 A 2/1994 Hofmann
5,339,993 A 8/1994 Groya et al.
5,346,086 A 9/1994 Harris
D352,899 S 11/1994 Molo
D355,121 S 2/1995 Kohl
D355,846 S 2/1995 Denney et al.
D363,222 S 10/1995 Lay
D363,671 S 10/1995 Mueller
5,499,736 A 3/1996 Kohl
D369,942 S 5/1996 Ahern, Jr.
5,531,347 A 7/1996 Goulding
5,549,214 A * 8/1996 Harris ..... 220/254.3
5,611,451 A 3/1997 Mosior et al.
5,706,981 A 1/1998 Nobakht
5,718,347 A 2/1998 Walker et al.
5,730,310 A 3/1998 Yoshihara
5,782,388 A 7/1998 De Nervo
5,797,523 A * 8/1998 Gross ..... 222/556
5,799,838 A 9/1998 Miller
D407,976 S 4/1999 Ekkert
5,927,535 A 7/1999 Goth
D426,772 S 6/2000 Kahl
6,102,257 A 8/2000 Goyet
D448,296 S * 9/2001 Bried et al. ..... D9/449
D448,668 S * 10/2001 Baerenwald et al. ..... D9/449

* cited by examiner

CONTAINER LID

FIELD OF THE INVENTION

The present invention relates generally to container lids, and more particularly relates to doors provided in container lids.

BACKGROUND OF THE INVENTION

Containers employ lids of all shapes, sizes and with various dispensing structures. For example, a hole or an array of holes is often provided in the lid for dispensing the contents of the container, while a door is operable to cover and reveal the dispensing holes. One type of door is a double hinged door. Such a door typically comprises two different sections hinged together, one of those sections being hinged to the lid. The structure of the lid beneath the door is designed such that pressing downwardly on the door section hinged to the lid causes the other door section to flip upwardly revealing the hole or other dispensing structure.

Unfortunately, many of these double hinged doors suffer from several drawbacks. For example, the opening of these doors is largely uncontrolled and unregulated. Inadvertent pressure on the door can cause one part of the door to flip upwardly and exposing the contents of the container. Also, when rotation of the door sections is relatively uncontrolled, a section can rotate into the fingers of the person operating the door, in effect "snapping" their finger(s). Also, the door sections go through numerous and repeated stresses throughout their lifetime, they are subject to excess wear that can hinder the operation of the door. Finally, the structure of the lid that causes the one door portion to rotate relative to the other, takes up needed space within the container that could otherwise be used by additional product.

BRIEF SUMMARY OF THE INVENTION

In light of the above, it is a general aim of the present invention to provide a container lid having a double hinged door that is operated in a controlled and positive acting manner.

In that regard, it is an object of the present invention to prevent inadvertent opening of a double hinged door.

It is another object of the present invention to prevent uncontrolled opening of a double hinged door in which the door snaps the finger(s) of a person opening the door.

It is yet another object of the present invention to provide a lid for a container having a double hinged door that increases the available space in the container.

In accordance with these objects, the present invention provides a lid for a container generally comprising a main body and a door having a flip section pivotally connected to a push section, the push section pivotally connected to the main body. The main body includes a recess that defines a pivot wall. The flip section is positioned to engage the pivot wall and rotate relative to the push section in response to downward pressure on the push section. A detent mechanism is used to control opening the door in at least two stages. In the first stage, the detent mechanism substantially fixes the push section in a closed position, and in the second stage substantially fixes the push section in an open position.

According to more detailed aspects of the present invention, the flip section is limited in rotation relative to the main body. In the first stage, the flip section is limited in rotation to a first degree, and in the second stage is limited to a second degree, the second degree being larger than the first. Preferably, the first degree is limited to 0° to 45°, while the second degree is limited to 45° to 90°. In a related embodiment of the present invention, the detent mechanism controls opening of the door in three stages corresponding to three incremental positions of the flip section. These positions of the flip section include a closed position generally parallel to the push section, a partially open position rotated towards the push section, and a fully open position rotated further towards the push section.

According to another embodiment of the present invention, a container lid is provided generally comprising a main body having a recess therein defined by a pivot wall and two side walls. A door is sized to be received within the recess and comprises a flip section pivotally connected to a push section, the push section pivotally connected to the main body. Each side wall of the recess includes two vertically spaced notches. The door has a tab on opposing sides of the push section, each tab positioned to sequentially engage the two notches in their respective side wall. In related embodiments, the side walls may further include additional notches vertically spaced apart, to provide a controlled and positive acting double hinged door. Preferably, the door is operable between an open position and a closed position, the tabs engaging the upper notches in the closed position and engaging the lower notches in the open position. Stated another way, the door opens in two stages, the tab engaging the upper notch during the first stage and engaging the lower notch during the second stage. Preferably, the position of the hinged connection of the push and flip sections, and the depth of the recess, are both controlled to limit the rotation of the flip section relative to the push section to less than 90°. According to one embodiment, downward pressure on the push section results in the flip section disengaging the main body prior to the tabs disengaging the upper notches. According to another embodiment, downward pressure on the push section results in the flip section disengaging the main body at about the same time as the tabs disengage the upper notches.

According to a further embodiment of the present invention, a container lid is provided generally comprising a planar body having a recess therein defining a pivot wall. A door is sized to be received within the recess, the door comprising a flip section pivotally connected to a push section, the push section being pivotally connected to the main body. The flip section is positioned to engage the pivot wall and rotate relative to the push section in response to downward pressure on the push section. The push section is selectively operable between at least two detented positions corresponding to open and closed positions of the flip section. Preferably, a detent mechanism substantially fixes the position of the push section in the two locked positions.

According to yet another embodiment of the present invention, a container lid is provided generally comprising a main body having a recess therein defined by a pivot wall, a rear wall and a floor. A door is sized to be received within the recess, the door comprising a flip section pivotally connected to a push section, the push section pivotally connected to the main body adjacent the rear wall. The flip section is positioned to engage the pivot wall and rotate toward the push section in response to the push section moving downwardly to an open position in the recess. The majority of the floor of the recess is angled downwardly and inwardly from the rear wall from the pivot wall. The lid therefore provides increased space within the container. Preferably, the push section is disposed proximate the angled portion of the floor when in the open position, whereby the floor can limit the flexure of the push section to increase its life. Preferably, the angled portion of the floor is angled more than the push section is angled when in the open position.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figures 1, 2, 3:
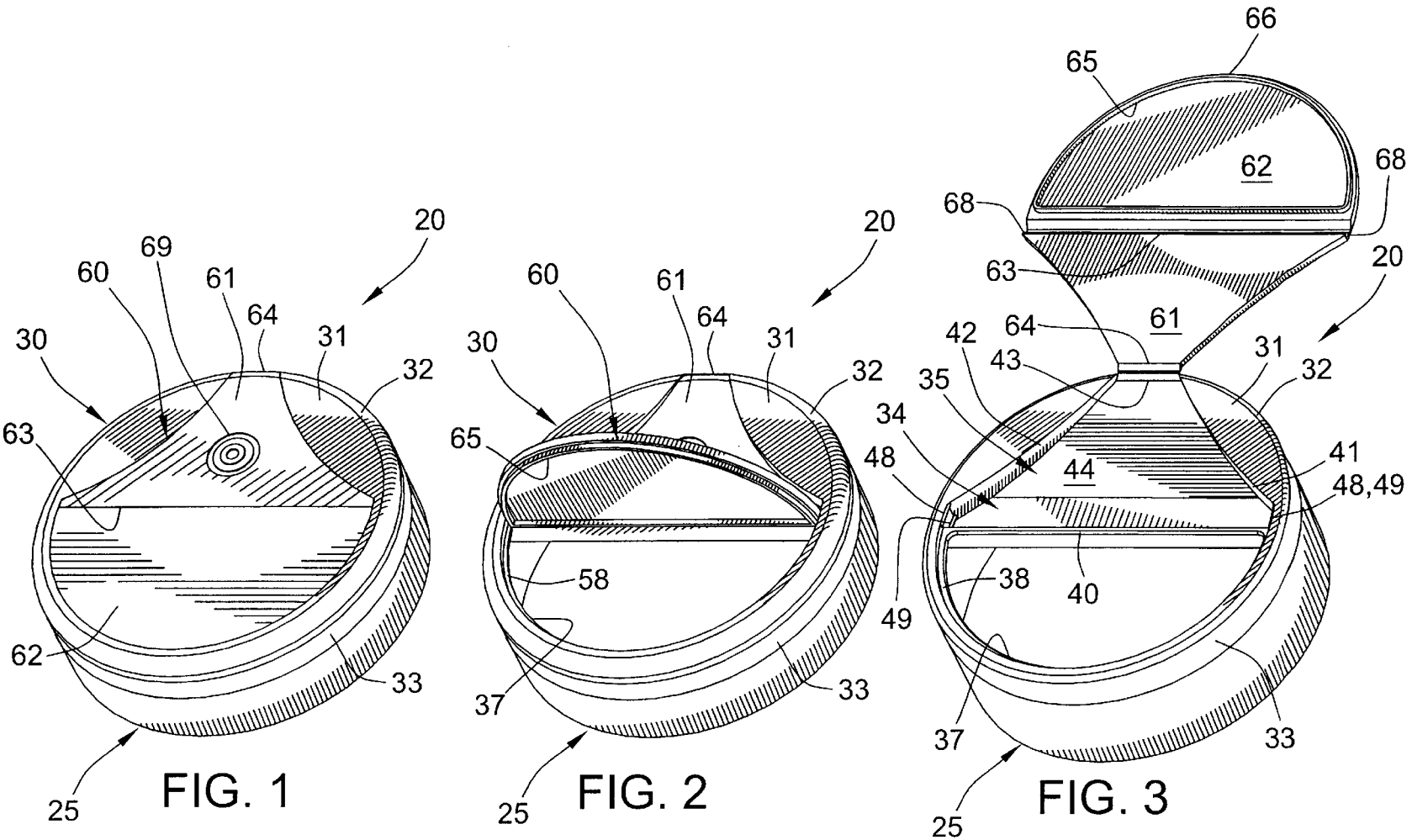
FIG. 1 is a perspective view of an embodiment of the container and lid assembly constructed in accordance with the teachings of the present invention.
FIG. 2 is a perspective view of the container and lid assembly of FIG. 1 having the door in an open state.
FIG. 3 is a perspective view of the container and lid assembly of FIG. 1 showing the lid in an as-molded condition.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Referring now to the drawings, FIGS. 1–8 illustrate one embodiment of the present invention. The general structure and operation of the present invention will be described in reference to these figures. Then, a few of the many alternate embodiments of the present invention will be described with reference to FIGS. 9–15. All of the figures depict a container and lid assembly, although the present invention is directed primarily towards the lid portion of the assembly.

Figure 4:
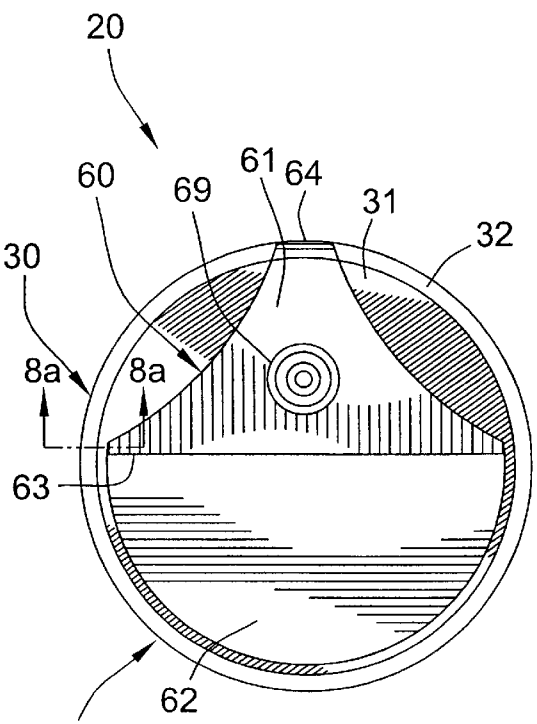
FIG. 4 is a top view of the container and lid assembly of FIG. 1.

With reference to FIGS. 1 and 4, a container and lid assembly 20 is depicted and generally comprises a cylindrical container 25 and a round and generally planar lid 30. The lid 30 of the present invention generally comprises a main body 31 and a door 60. The main body 31 includes a radiused outer peripheral edge 32 and a downwardly depending skirt 33 which engages the upper edge of the container 25. The door 60 generally comprises a push section 61 pivotally connected to a flip section 62 by a hinge 63. The hinge 63 is preferably a living hinge integrally formed with each of the push and flip sections 61, 62. The push section 61 is pivotally connected to the main body 31 via another living hinge 64 integrally formed with the outer peripheral edge 32. Hinge 64 comprises a thin strip of flexible material and maintains the radius of the outer peripheral edge 32, i.e., the hinge 64 is generally flush with the outer peripheral edge 32, both vertically and horizontally. It will also be recognized that the hinge 64 may also project, typically horizontally, from the outer periphery of the edge 32 and container 25, as is known in the art.

Figure 5:
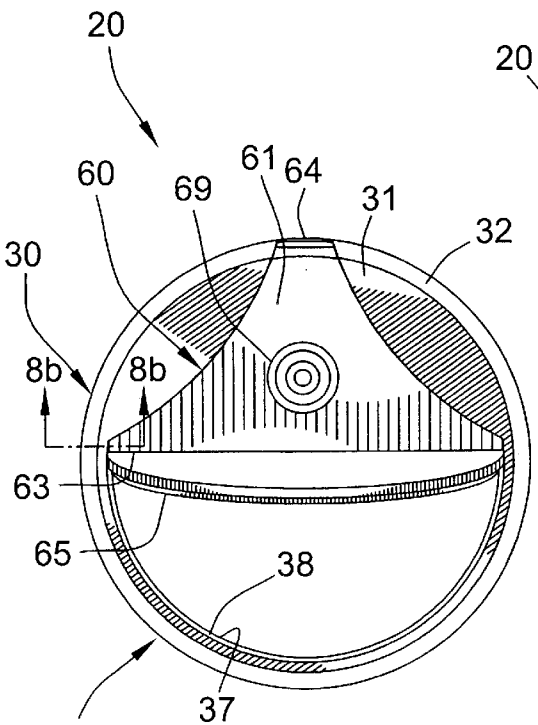
FIG. 5 is a top view if the container and lid assembly of FIG. 2.

As illustrated in FIGS. 2, 5 and FIGS. 3, 6, the double hinged lid 30 is structured such that the door 60 is easily and positively actuated to open in several stages. FIGS. 2 and 5 illustrate the door 60 in an open position. In response to downward pressure or force on the push section 61, the flip section 62 rotates upwardly and towards the push section 61 about hinge 63. Stated another way, the flip section 62 has rotated away from the main body 31. Preferably, the push section 61 includes an indication of where to press on the lid 30 and its door 60, such as the bullseye 69 shown in the figures. In the closed position depicted in FIGS. 1 and 4, the push section 61 and flip section 62 were generally parallel to one another. In the state depicted in FIGS. 2 and 5, the lid has rotated to an open position, that position preferably being less than or equal to 90 degrees rotated relative to the main body 31. Most preferably, the flip section 62 rotates in the range of 45 to 90 degrees from the main body in the open position. The position of hinge 63 relative to pivot wall 40, as well as the depth of the recess 34 (best seen in FIGS. 3 and 6 and further described below) are controlled to regulate the rotation of the flip section 62 as proscribed above.

Figure 6:
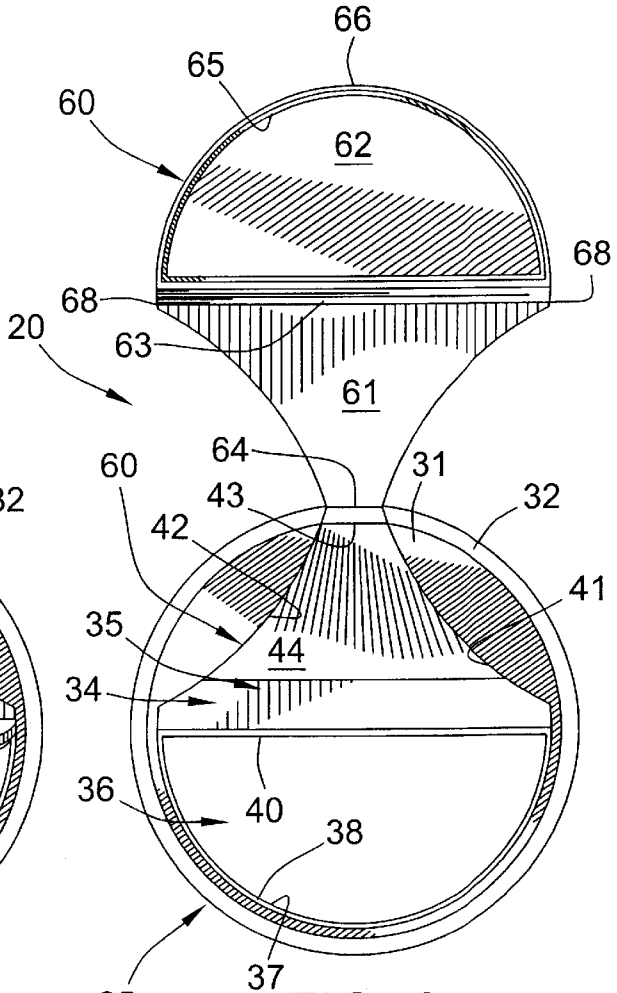
FIG. 6 is a top view of the container and lid assembly of FIG. 3.

FIGS. 3 and 6 depict the lid 30 having its door 60 in an as-molded state. In this condition, the push section 61 has rotated relative to the main body about hinge 64. The main body 31 includes a recess 34 generally comprising a first portion 35 and a second portion 36. The first portion 35 is sized to receive the push portion 61 of the door 60. The first portion 35 of the recess 34 is defined by a pivot wall 40 and a rear wall 43 connecting a pair of opposing side walls 41, 42. The push section 61 is hingedly connected to the main body 30 adjacent the rear wall 33. The flip section 62 includes a nub 66 that allows the flip portion 62 of the door 60 to frictionally and securely engage the main body 31 of the lid 30 in the closed position. The main body 31 may include a corresponding groove (not shown) to receive and engage the nub 66.

The second portion 36 of the recess 34 is sized to correspond with the flip section 62 of the door 60. In the floor of the second portion 36 of the recess 34, there is defined a dispensing hole 37 for gaining access to the contents of the container. The second portion 36 of the recess 34 and the dispensing hole 37 define a ledge 38 for supporting the outer periphery of the flip section 62. Additionally, the flip section 62 preferably contains a sealing ring 65 projecting downwardly from an underside of the flip section 62. The sealing ring 65 is sized to correspond with the dispensing hole 37 and frictionally engages the outer edges of the hole 37 to effectively seal the contents of the container 25.

Figure 7:
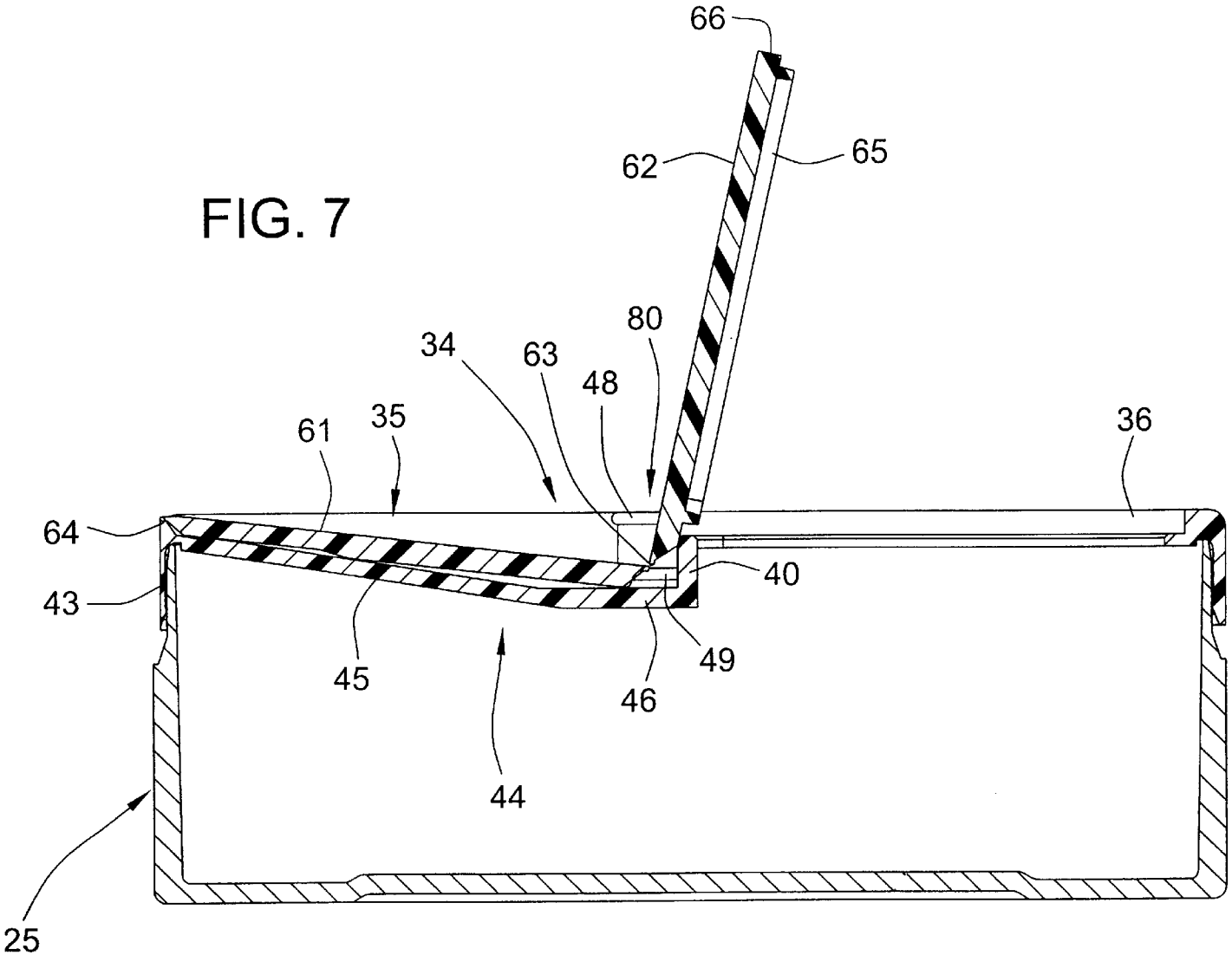
FIG. 7 shows a cross-sectional view of the container and lid assembly taken about the line 7—7 of FIG. 5.
Figure 8A:
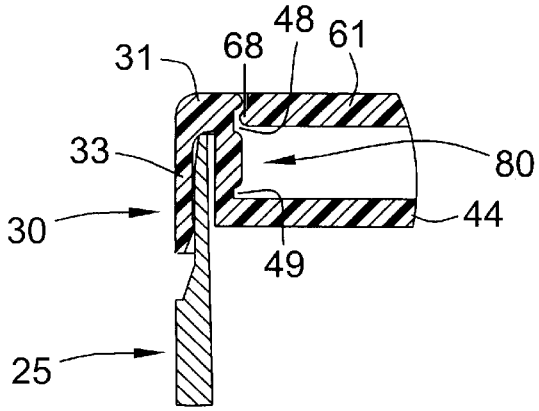
FIG. 8*a* is a cross-sectional view of the container and lid assembly taken about the line 8*a*—8*a* of FIG. 4.
Figure 8B:
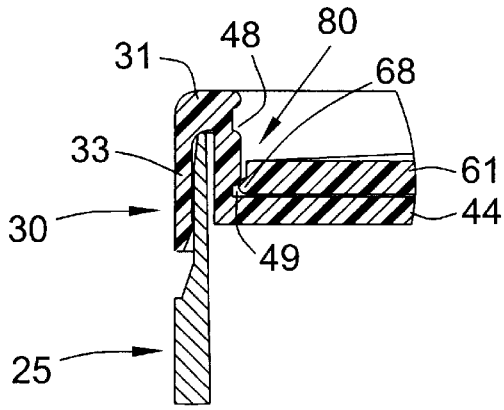
FIG. 8*b* is a cross-sectional view of a container and lid assembly taken about the line 8*b*—8*b* of FIG. 5.
Figure 8C:
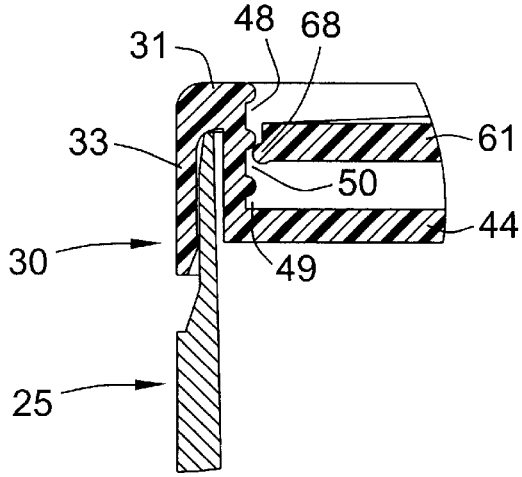
FIG. 8*c* is a cross-sectional view of a container and lid assembly similar to 8*a* and 8*b* depicting an alternate embodiment of the detent mechanism.
Figure 8D:
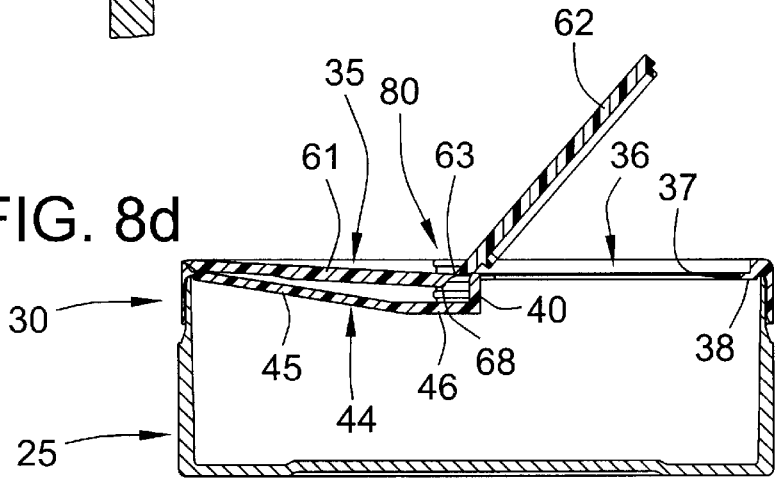
FIG. 8*d* is a cross-sectional view similar to FIG. 7 but showing an alternate embodiment of the detent mechanism.

It can be seen in FIGS. 7 and 8*d* that the floor 44 of the recess 34 is sloped. Preferably, a first portion of the floor 45, representing a majority of the floor, is angled to slope downwardly and inwardly from a position adjacent the rear wall 43 and the hinge 64. The remaining portion of the floor 46 is generally flat or horizontal. Preferably, a substantial portion of the floor of the recess is angled downwardly and inwardly. The angled portion 45 of the floor 44 serves several purposes. First, the structure eliminates unused space to create increased holding capacity in the container 25. The angled floor portion 45 also limits the flexure of the push section 61, thereby increasing its life under repeated stresses. It can be seen in FIG. 7 that the push section 61 is disposed proximate the angled portion 45 of the floor 44 when in the open position, corresponding to a first open position of the flip section 62. Since the angles of the push section 61 and angled floor portion 45 are somewhat similar, the angled floor portion 45 being angled relative main body 31 slightly more than the push section 61 is angled, the amount of flexure in the push portion 61 is very limited.

With reference to FIGS. 6, 7 and 8*a*–8*d*, the positive acting and controlled opening of the door 30 will be described in more detail. The lid 30 contains a detent mechanism 80 to control the opening of the door 60. The location of the hinge 63 connecting the push section 61 and flip section 62 is selected such that downward pressure on the push section 61 causes the flip section 62 to engage the pivot wall 40. As the push section 61 rotated downwardly into the first recessed portion 35, the flip section 62 rotates upwardly, away from the main body 31 and towards the push section 61. The detent mechanism 80 controls this opening, and in the preferred embodiment comprises a pair of notches 48, 49 (FIGS. 7 and 8*a*) formed in each opposing side wall 41, 42 of the recess 34, and more particularly the first portion 35 of the recess 34. The push section 61 of the door 60 includes a tab 68 (FIGS. 6 and 8*a*) on each opposing side positioned to correspond with the pair of notches 48, 49. Each tab 68 is positioned to sequentially engage the two notches 48, 49 in the respective side wall 41, 42. The detent mechanism may also be reversed with the notches on the door and the tabs on the side walls.

The detent mechanism 80 controls the opening of the door 60 in at least two stages, as represented in FIGS. 8*a* and 8*b*. In the first stage, the detent mechanism 80 substantially fixes the push section 61 in a closed position. In the second stage, the detent mechanism substantially fixes the push section in an open position. More specifically, in the closed position (depicted in FIGS. 1 and 4) the tabs 68 of the push section 61 engage the upper notch 48 as shown in FIG. 8*a*, thereby positioning the flip section 62 in a position generally parallel with the push section 61 and the main body 31. The detent mechanism 80 thus prevents inadvertent opening of the door 60. In response to downward pressure on the push section 61, the tabs 68 disengage the upper notches 48 and move downwardly until they are positively positioned within the lower notches 49 as shown in FIG. 8*b*. In this open position of the push section 61, the flip section 62 has engaged the pivot wall 41 and rotated towards the push section 61 to its open position. With the flip section 62 in the open position, access to the container 25 is possible through the dispensing hole 37, and the door 60 may be completely moved by merely grasping either section of the door and causing the push section 61 to rotate relative to the main body 31 about its hinge 64. The push section 61 is thus selectively operable between at least two locked positions corresponding to open and closed positions of the flip section 62 (FIGS. 1 and 4, and FIGS. 2 and 5).

With reference to FIGS. 8*c* and 8*d*, the detent mechanism 80 may further comprise additional notches corresponding to additional stages or stages of open positions of the door 60. In FIGS. 8*c* and 8*d*, a third notch 50 is positioned adjacent the first and second notches 48, 49, all of which are vertically spaced. In this embodiment, the door 60 starts in a closed position (FIG. 8*a*) wherein the push section 61 is generally horizontal having its tabs 68 engaging the upper notch 48. Upon a downward pressure, the push section 61 disengages the upper notch 48 and then rotates downwardly to engage the middle notch 50. In this position, namely a partially open position (FIG. 8*c*), the flip section 62 has rotated a much smaller amount than as depicted in FIG. 7, due to the additional detent. Preferably, the partially open position corresponds with an angle of 0 to 45 degrees, as is shown in FIG. 8*d*. Upon further pressure on the push section 61, the tabs 68 disengage the middle notch 50 and move to the lower notch 49. This stage corresponds to a fully open position (FIGS. 2 and 5), wherein the flip section 62 has rotated more than in the partially open position, as can be seen from the open position shown in FIG. 7. In this fully open position, the flip section 62 has preferably rotated relative to the main body 31 about 45 to 90 degrees, most preferably less than 90 degrees.

It will be recognized by those skilled in the art that any number of detents, i.e. notches, can be utilized to stage or otherwise effectively control the opening of the double hinge door 60. It will also be recognized that the multiple staged opening as depicted in the embodiment of FIGS. 8*c* and 8*d*, can be effectuated with only two notches. To accomplish this, the position of the upper notch 48 must be closely regulated. The flip section 62 of the door frictionally engages the main body 31, typically via the nub 66 and/or the sealing ring 65. The amount of downward pressure on the push section 61 to disengage the tabs 68 from the upper notches 48 can be regulated such that the downward pressure causes the flip section 62 to disengage from its frictional engagement with the main body 31 prior to the tabs 68 disengaging the upper notches 48. In this way, the flip section 62 may be rotated upward slightly, generally corresponding with the closed or partially open position (i.e. 0 to 45 degrees). Furthermore, this allows the entire door 60 to be placed in the as-molded position (as depicted in FIGS. 3 and 6) without causing the tabs 68 to disengage the upper notch 48 and move downwardly to engage the lower notch 49, before the entire door 60 may be placed in the as-molded position. However, in the preferred embodiment, the notches 48, 49 are positioned such that the push section 61 rotates due to the tabs 68 disengaging the upper notch 48 at about the same time the flip section 62 disengages the main body 31 and rotates upwardly towards the push section 61.

Figure 9A:
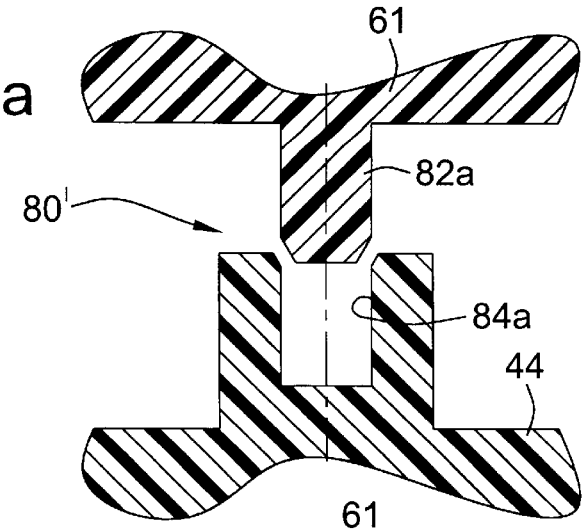
FIGS. 9*a*, 9*b* 9*c*, 9*d* and 9*e* are cross-sectional views, partially cut away, of alternate embodiments of detent mechanisms constructed in accordance with the teachings of the present invention.
Figure 9B:
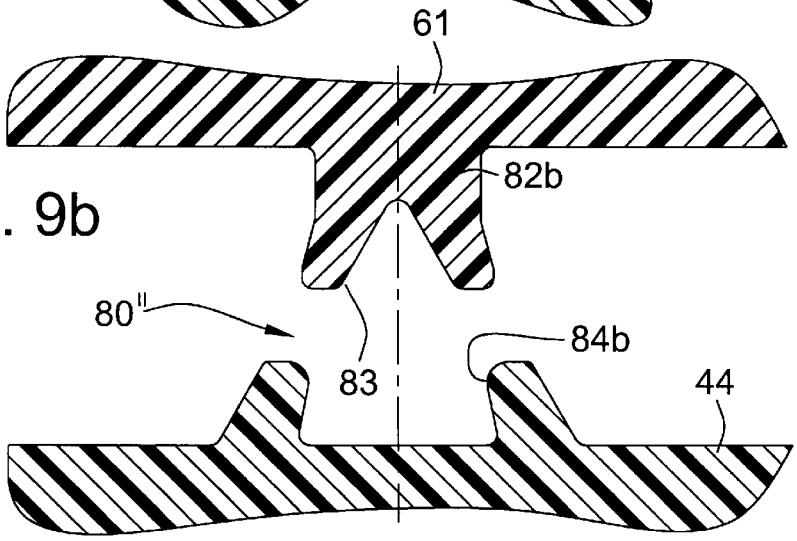
Figure 9C:
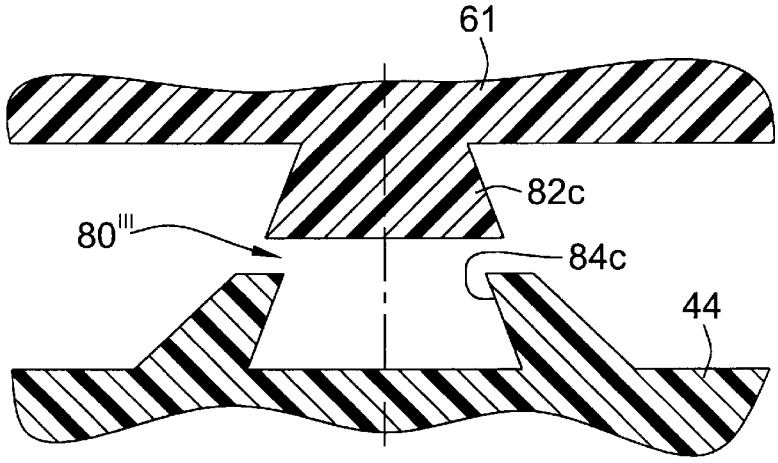

It will also be recognized by those skilled in the art that various other detent mechanisms may be utilized. As used in the specification, a detent or detent mechanism represents any structure that restricts or locks the movement of one part of a mechanism. FIGS. 9*a*, 9*b* and 9*c* illustrate alternate embodiments of the detent mechanism 80 which may be utilized in accordance with the teachings of the present invention. It will first be recognized that while the detent mechanism 80 is shown in the embodiment depicted in FIGS. 1–8 is formed into the side walls 41, 42 of the recess 34, a similar mechanism may be easily formed in the pivot wall 40 and an edge of the push section 61 of the door adjacent the hinge 63. Preferably, the detent mechanism 80 is located adjacent pivot wall 40 or away from hinge 64, to control the push section 61 where most of the section's movement occurs, thus providing the most control. It will also be recognized that the underside of the push section 61 may include a pin and socket, or tongue and groove, type of detent mechanism to effectuate the same controlled and staged opening of the door 60. Such alternate detent mechanisms are shown in FIGS. 9*a–c*, all of which are located on the underside of push section 61, preferably at a position directly below the bullseye 69 where downward pressure is placed for opening the door 60.

Figure 9D:
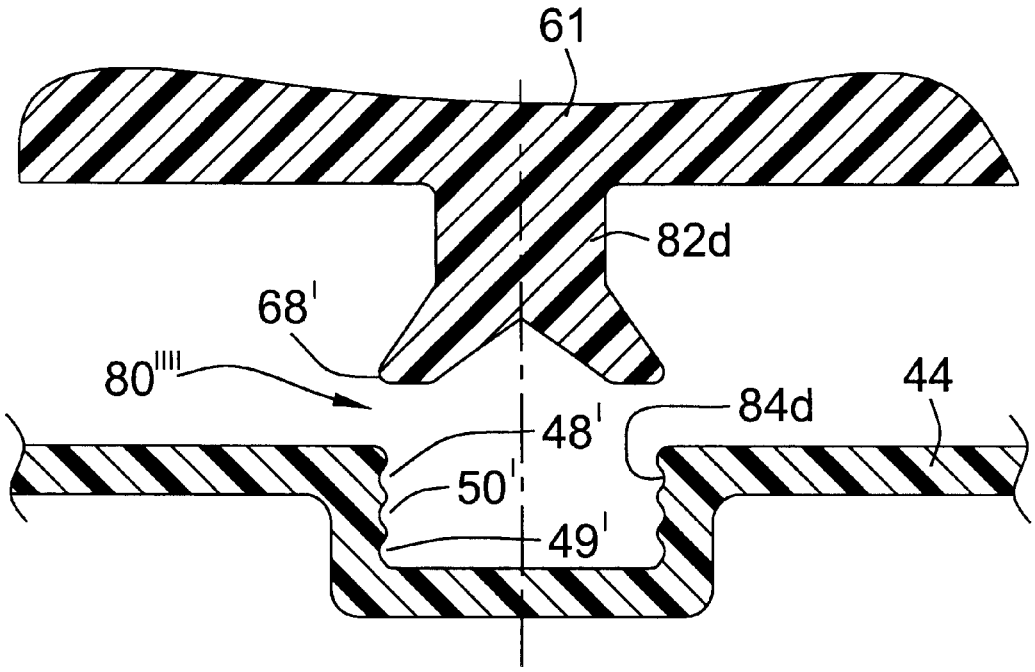
Figure 9E:
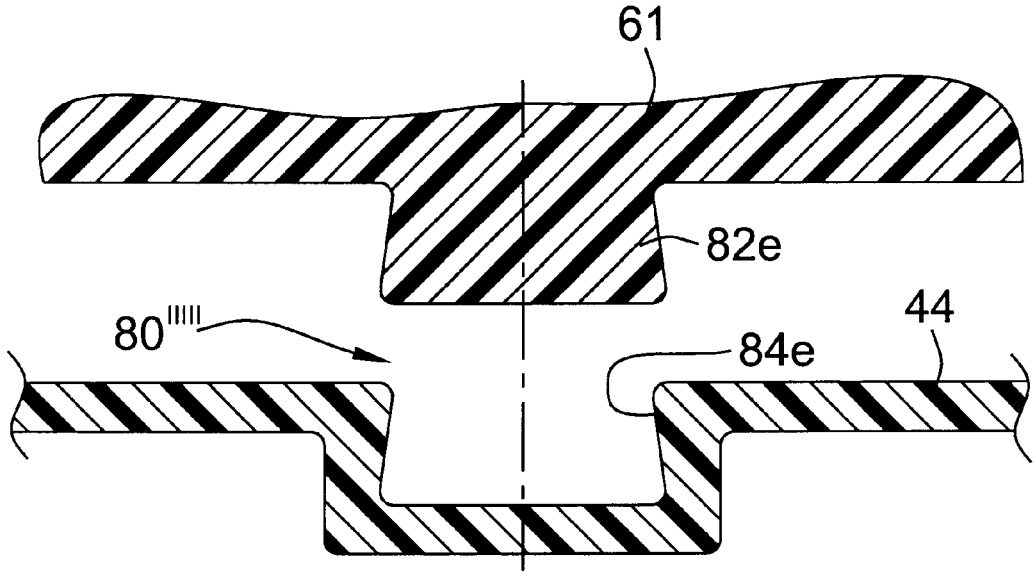

FIGS. 9*a–e* illustrate cross-sectional, partially cut-away, views of such detent mechanisms. As shown in FIG. 9*a*, the push section 61 of the door 60 may include a pin 82*a* which depends downwardly from the door 60. The floor 44 includes a female socket 84*a* sized to receive the pin 82*a*, forming the detent mechanism 80'. The pin 82*a* and socket 84*a* provide an interference fit when the push section is rotated downwardly. FIG. 9*b* illustrates an alternate embodiment of a pin and socket design for a detent mechanism 80". In this situation, the pin 82*b* is generally flared and includes a recessed portion 83. The recess portion 83 permits the edges of the pin 82*b* to deflect inwardly to be received within the socket 84*b*, which includes a sloped hole corresponding with the shape of the pin 82*b*. Another embodiment depicted in FIG. 9*c* includes a tongue and groove type detent mechanism 80'" which includes a deflectable tongue 82*c* sloping outwardly as it projects downwardly from the underside of the push section 61. A correspondingly shaped groove 84*c* is provided in the floor 44 of the recess. Preferably, the tongue 82*c* and groove 84*c* run generally parallel with the pivot wall 40 and hinge 63. FIGS. 9*d* and 9*e* illustrate further embodiments with alternate detent mechanisms 80"", 80"" having differently configured tongues 82*d*, 82*e* and grooves 84*d*, 84*e*. Groove 84*d* includes several detent notches 48', 49', 50' which can receive and hold tab 68' for staged opening.

While the embodiments depicted in FIGS. 9*a*, 9*b*, 9*c*, 9*d* and 9*e* only include description of detent mechanisms 80', 80", 80'", 80"" and 80"" which lock the position of the push section 61 in a downward or open position of the push section 61 corresponding with an open position of the flip section 62, it will be readily recognized by those skilled in the art that such detent mechanisms can be adapted to provide a staged opening as was described with reference to FIGS. 1–8. For example, the inner walls of the sockets 84*a* and 84*b*, and grooves 84*c*, 84*d* and 84*e* may include vertically spaced notches for sequential engagement by tabs on the pins 82*a* and 82*b* and tongues 82*c*, 82*d* and 82*e*, such as is shown in FIG. 9*d*. As previously stated, other known detent mechanisms can be employed in conjunction with the present invention.

Figures 10, 11, 12:
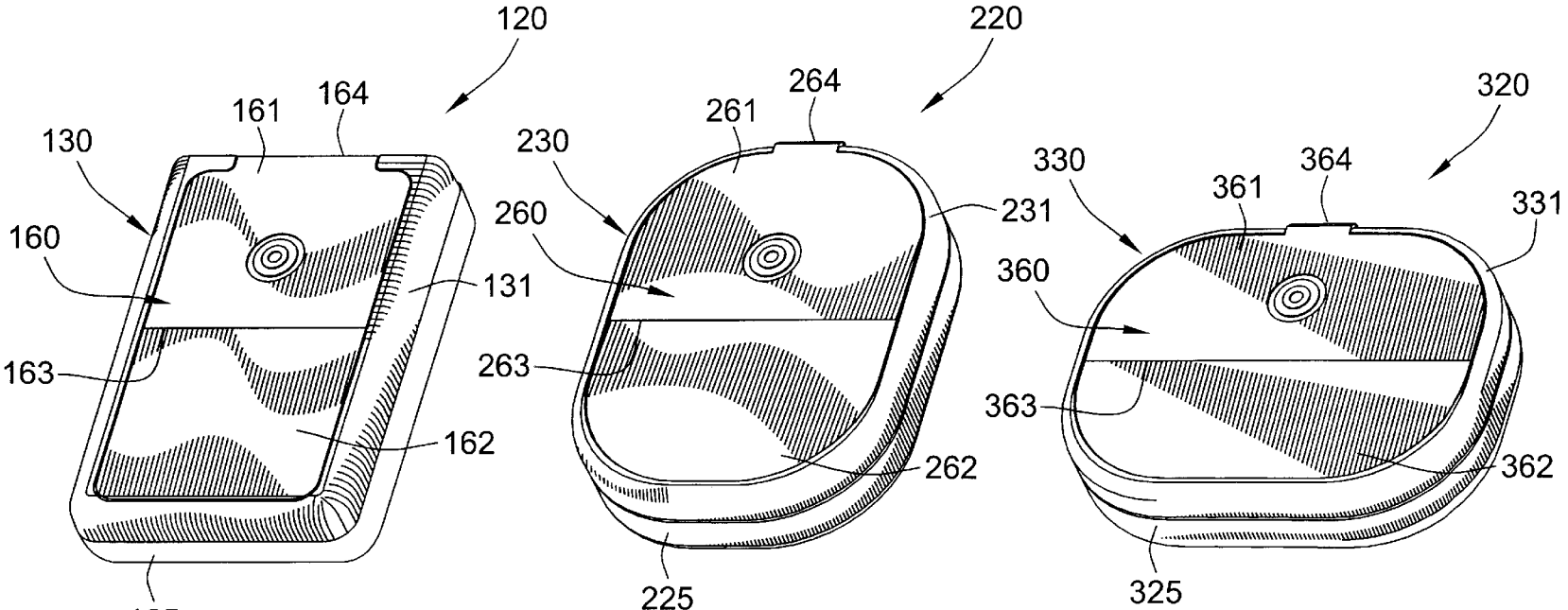
FIG. 10 shows a perspective view of another embodiment of a container and lid assembly constructed in accordance with the teachings of the present invention.
FIG. 11 shows a perspective view of another embodiment of a container and lid assembly constructed in accordance with the teachings of the present invention.
FIG. 12 shows a perspective view of another embodiment of a container and lid assembly constructed in accordance with the teachings of the present invention.
Figure 15:
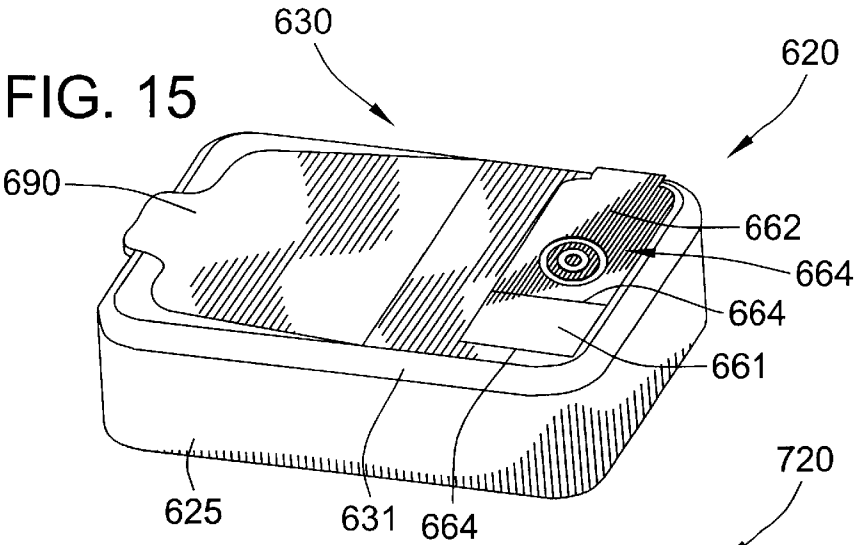
FIG. 15 shows a perspective view of another embodiment of a container and lid assembly constructed in accordance with the teachings of the present invention.
Figure 16:
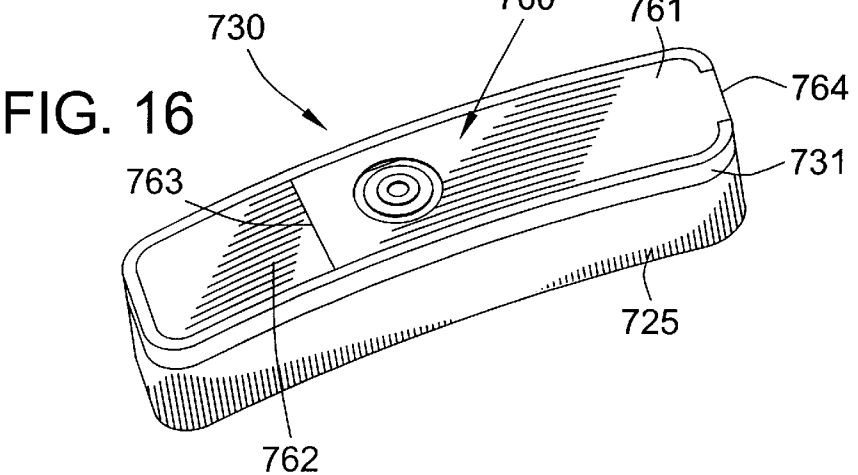
FIG. 16 shows a perspective view of another embodiment of a container and lid assembly constructed in accordance with the teachings of the present invention.
Figure 13:
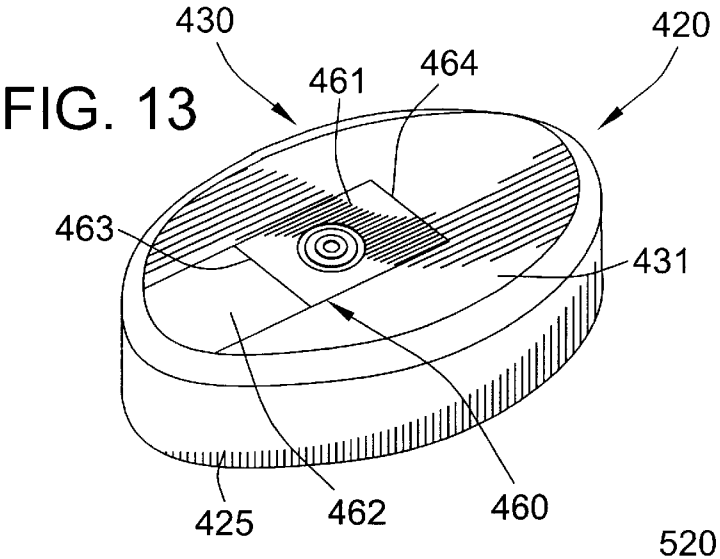
FIG. 13 shows a perspective view of another embodiment of a container and lid assembly constructed in accordance with the teachings of the present invention.
Figure 14:
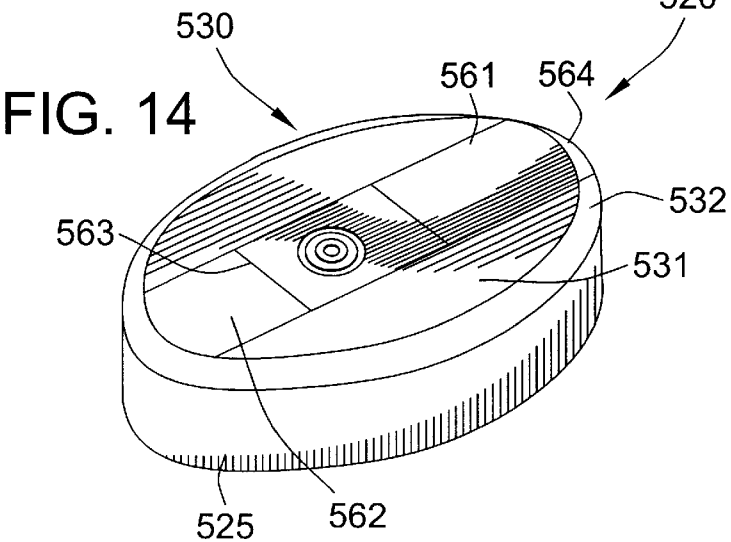
FIG. 14 shows a perspective view of another embodiment of a container and lid assembly constructed in accordance with the teachings of the present invention.

FIGS. 10–16 illustrate various other embodiments of container and lid assemblies employing the lid of the present invention. Common reference numerals will be used, although they will increase by 100's for each figure. FIG. 10 illustrates a generally rectangular container 125 having a corresponding lid 130. The lid 130 is constructed in accordance with the teachings of the present invention and includes a double hinged door 160 comprising a push section 161 and a flip section 162. The outer surface of the push section 161 includes a bullseye or other indication where to press to open. The push section 161 is pivotally connected to the flip section 162 by hinge 163 and pivotally connected to the main body 131 via a hinge 164. FIG. 11 is also generally rectangular although the corners are somewhat rounded. FIG. 11 depicts the door 260 longwise, generally similar to FIG. 10. FIG. 12 is substantially similar to FIG. 11 in overall shape, although the door 360 is generally shortwise, i.e. the width of the door 360 corresponds to a length of the container 325. FIG. 13 illustrates a circular container and lid assembly 420 having thin rectangular door 460, wherein the push section 461 is hinged to a mid portion of the main body 431 of the lid 430. Similarly, FIG. 14 illustrates an embodiment like that of FIG. 13 having a thin door 560, however the push section 561 of the door 560 is elongated and is pivotally connected to the main body 531 adjacent the outer periphery 532 of the main body 531. The door of the present invention may also be employed in conjunction with other doors, such as depicted in the lid 630 of FIG. 15. A thin double hinged door 660 is positioned shortwise along an end of the lid 630, while the other end of the lid 630 includes an additional door 690 that is independently operable. Finally, FIG. 16 illustrates a lid 730 which is generally curved or arcuate, the door 760 also being curved and covering a substantial portion of the lid 730. The lid of FIG. 16 is ideal for flask type container 725.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A lid for a container comprising:

a main body having a recess therein defining a pivot wall;

a door received within the recess, the door comprising a flip section pivotally connected to a push section, the push section pivotally connected to the main body with no hinge pins;

the flip section engaging the pivot wall and rotating relative to the push section in response to downward pressure on the push section; and a detent mechanism interposed between the push section and the main body to control the opening of the door in at least two stages, the detent mechanism substantially fixing the push section in a closed position in a first stage, and substantially fixing the push section in an open position in a second stage.

2. The lid of claim 1, wherein the flip section is limited in rotation relative to the main body to a first degree $\alpha$ in the first stage, and wherein the flip section is limited in rotation relative to the main body to a second degree $\beta$ in the second stage, $\beta$ being greater than $\alpha$.

3. The lid of claim 2, wherein a $\alpha$=0° to 45°.

4. The lid of claim 2, wherein $\beta$=45° to 90°.

5. The lid of claim 2, wherein $\beta$ is less than 90°.

6. The lid of claim 1, wherein the detent mechanism controls the opening of the door in three stages corresponding to three incremental positions of the flip section including:

a closed position generally parallel to the push section;

a first open position rotated towards the push section; and a second open position rotated further towards the push section.

7. The lid of claim 6, further comprising opposing side walls of the recess, wherein the detent mechanism comprises two vertically spaced notches in each opposing side wall and a tab on opposing sides of the push section positioned to sequentially engage the two notches in the respective side wall.

8. A lid for a container comprising:

a main body having a recess therein defined by a pivot wall and two side walls;

a door sized to be received within the recess, the door comprising a flip section pivotally connected to a push section, the push section pivotally connected to the main body;

each side wall of the recess having two vertically spaced notches; and the door having a tab on opposing sides of the push section, each tab positioned to sequentially engage the two notches in the respective side wall.

9. The lid of claim 8, wherein the door is operable between a first open position and a closed position, the tabs engaging the upper notches in the closed position and engaging the lower notches in the first open position.

10. The lid of claim 9, wherein the flip section frictionally engages the main body in the closed position to securely position the flip section, the tabs engaging the upper and lower notches to securely position the push section in the closed and first open positions.

11. The lid of claim 9, wherein the door is further operable to a second open position, the tabs not engaging the upper or lower notches in the second open position.

12. The lid of claim 8, wherein the door opens in two stages, the tab engaging the upper notch during the first stage and engaging the lower notch during the second stage.

13. The lid of claim 12, wherein the first and second stages correspond to two unequal downward pressures on the push section of the door.

14. The lid of claim 12, wherein the flip section is limited in rotation to a first degree $\alpha$ relative to the main body in the first stage, and limited in rotation to a second degree $\beta$ relative to the main body in the second stage, wherein $\beta$ is greater than $\alpha$.

15. The lid of claim 14, wherein $\beta$ is less than 90°.

16. The lid of claim 8, wherein the position of the hinged connection between the push and flip sections relative to the pivot wall, and the depth of the recess, are both controlled to limit the rotation of the flip section relative to the push section to less than 90°.

17. The lid of claim 8, wherein the recess includes a floor, a portion of the floor below the push section being angled downwardly and inwardly from a position adjacent the hinged connection of the push section and main body.

18. The lid of claim 10, further comprising an aperture in a floor of the recess and a sealing ring projecting from an underside of the flip section of the door, the sealing ring sized to engage the outer periphery of the aperture.

19. The lid of claim 10, wherein downward pressure on the push section results in the flip section disengaging the main body prior to the tabs disengaging the upper notches.

20. The lid of claim 10, wherein downward pressure on the push section results in the flip section disengaging the main body at about the same time as the tabs disengage the upper notches.

21. A lid for a container comprising:

a planar body having a recess therein defining a pivot wall;

a door received within the recess, the door comprising a flip section pivotally connected to a push section, the push section pivotally connected to the main body with no hinge pins;

the flip section engaging the pivot wall for rotation relative to the push section in response to downward pressure on the push section; and the push section having a detent mechanism to control opening of the flip section between at least two locked positions corresponding to open and closed positions of the flip section.

22. The lid of claim 21, wherein the push section is parallel to the main body in the first locked position, and is angled downwardly and inwardly in the second locked position.

23. The lid of claim 21, wherein the push section is operable between three locked positions corresponding to closed, first open and second open positions of the flip section, the flip section being rotated more in the second open position than the first open position.

24. The lid of claim 21, wherein the recess further defines two opposing side walls, and wherein the detent mechanism comprises two vertically spaced notches in each opposing side wall and a tab on opposing sides of the push section positioned to sequentially engage the two notches in the respective side wall.

25. A lid for a container comprising:

a main body having a recess therein defined by a pivot wall, a rear wall and a floor;

a door comprising a flip section pivotally connected to a push section, the push section pivotally connected to the main body adjacent the rear wall, over the recess and without any hinge pins;

the flip section engaging the pivot wall upon the push section moving downwardly in the recess to rotate the flip section toward the push section to open the lid; and a majority of the floor of the recess being angled downwardly and inwardly from the rear wall towards the pivot wall.

26. The lid of claim 25, wherein the push section is disposed proximate the angled portion of the floor when in the open position.

27. The lid of claim 26, wherein the floor limits the flexure of the push section.

28. The lid of claim 23, wherein the angled portion of the floor is angled relative to the main body slightly more than the push section is angled relative to the main body when in the open position in the recess.

29. A lid for a container comprising:

a main body having a recess therein defining a pivot wall;

a door received within the recess, the door comprising a flip section pivotally connected to a push section, the push section pivotally connected to the main body;

the flip section engaging the pivot wall and rotating relative to the push section in response to downward pressure on the push section;

a detent mechanism interposed between the push section and the main body to control the opening of the door in at least two stages, the detent mechanism substantially fixing the push section in a closed position in a first stage, and substantially fixing the push section in an open position in a second stage;

wherein the flip section is limited in rotation relative to the main body to a first degree $\alpha$ in the first stage, and wherein the flip section is limited in rotation relative to the main body to a second degree $\beta$ in the second stage, $\beta$ being greater than $\alpha$; and wherein $\alpha$=0° to 45°.

30. A lid for a container comprising:

a main body having a recess therein defining a pivot wall;

a door received within the recess, the door comprising a flip section pivotally connected to a push section, the push section pivotally connected to the main body;

the flip section engaging the pivot wall and rotating relative to the push section in response to downward pressure on the push section;

a detent mechanism interposed between the push section and the main body to control the opening of the door in at least two stages, the detent mechanism substantially fixing the push section in a closed position in a first stage, and substantially fixing the push section in an open position in a second stage;

wherein the flip section is limited in rotation relative to the main body to a first degree a in the first stage, and wherein the flip section is limited in rotation relative to the main body to a second degree $\beta$ in the second stage, $\alpha$ being greater than $\alpha$; and wherein $\beta$=45° to 90°.

31. A lid for a container comprising:

a planar body having a recess therein defining a pivot wall;

a door received within the recess, the door comprising a flip section pivotally connected to a push section, the push section pivotally connected to the main body;

the flip section engaging the pivot wall for rotation relative to the push section in response to downward pressure on the push section;

the push section having a detent mechanism to control opening of the flip section between at least two locked positions corresponding to open and closed positions of the flip section; and wherein the push section is operable between three locked positions corresponding to closed, first open and second open positions of the flip section, the flip section being rotated more in the second open position than the first open position.

* * * * *

UNITED STATES PATENT AND TRADEMARK OFFICE

CERTIFICATE OF CORRECTION

PATENT NO. : 6,732,873 B2
DATED : May 11, 2004
INVENTOR(S) : Bried et al.

It is certified that error appears in the above-identified patent and that said Letters Patent is hereby corrected as shown below:

Title page,
Item [54], Title, change title "CONTAINER LID" to -- CONTAINER LID WITH CONTROLLED OPENING --.

Column 12,
Line 7, change "a in the first stage" to -- α in the first strage --.
Line 10, change "α being greater than α" to -- β being greater than α --.

Signed and Sealed this

Thirteenth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,732,873 B2
DATED : May 11, 2004
INVENTOR(S) : Bried et al.

It is certified that error appears in the above-identified patent and that said Letters Patent is hereby corrected as shown below:

Title page,
Item [54], Title, change title "CONTAINER LID" to -- CONTAINER LID WITH CONTROLLED OPENING --.

Column 12,
Line 7, change "a in the first stage" to -- α in the first stage --.
Line 10, change "α being greater than α" to -- β being greater than α --.

This certificate supersedes Certificate of Correction issued July 13, 2004.

Signed and Sealed this

Twenty-fourth Day of August, 2004

JON W. DUDAS
*Director of the United States Patent and Trademark Office*